US005915152A

United States Patent [19]

Meiri et al.

[11] Patent Number: 5,915,152

[45] Date of Patent: Jun. 22, 1999

[54] IMAGING DEVICE HAVING LIQUID TONER APPLICATOR USING A NOZZLE

[75] Inventors: Ilan Meiri, Yavne; Erez Heinsdorf, Ganei Tikva; Yevgeny Korol, Rehovot, all of Israel

[73] Assignee: Indigo N.V., GA Maastricht, Netherlands

[21] Appl. No.: 08/894,707

[22] PCT Filed: Jun. 6, 1995

[86] PCT No.: PCT/NL95/00191

§ 371 Date: Sep. 5, 1997

§ 102(e) Date: Sep. 5, 1997

[87] PCT Pub. No.: WO96/29633

PCT Pub. Date: Sep. 26, 1996

[30] Foreign Application Priority Data

Mar. 23, 1995 [IL] Israel ..... 113114
Mar. 26, 1995 [IL] Israel ..... 113131

[51] Int. Cl.[6] ..... G03G 15/10

[52] U.S. Cl. ..... 399/246

[58] Field of Search ..... 399/246, 247, 399/233; 347/43, 47; 118/629; 430/117–119

[56] References Cited

U.S. PATENT DOCUMENTS

| | | | |
|---|---|---|---|
| 3,654,896 | 4/1972 | Marx et al. | 118/50 |
| 3,910,231 | 10/1975 | Inoue et al. | 399/225 |
| 4,330,788 | 5/1982 | Hinz et al. | 347/151 |
| 4,421,056 | 12/1983 | Schinke | 399/233 |
| 4,684,238 | 8/1987 | Till et al. . | |
| 4,974,027 | 11/1990 | Landa et al. . | |
| 4,974,651 | 12/1990 | Carmon et al. . | |
| 4,985,732 | 1/1991 | Landa et al. . | |
| 5,047,808 | 9/1991 | Landa et al. . | |
| 5,089,856 | 2/1992 | Landa et al. . | |
| 5,231,454 | 7/1993 | Landa . | |
| 5,280,326 | 1/1994 | Pinhas et al. . | |
| 5,289,238 | 2/1994 | Lior et al. . | |
| 5,355,201 | 10/1994 | Hwang | 399/241 |
| 5,508,790 | 4/1996 | Belinkov et al. . | |

FOREIGN PATENT DOCUMENTS

| | | |
|---|---|---|
| 5-46029 | 2/1993 | Japan . |
| 9004216 | 4/1990 | WIPO . |
| 9014619 | 11/1990 | WIPO . |
| 9213297 | 8/1992 | WIPO . |

*Primary Examiner*—Robert Beatty
*Attorney, Agent, or Firm*—Greenblum & Bernstein, P.L.C.

[57] ABSTRACT

An imaging device including a selectively charged imaging surface, having a width and moving in a direction perpendicular to the width and a toner applicator, the applicator including an applicator chamber having a top portion and containing a supply of liquid toner and a slit nozzle having a long dimension comparable to the imaging surface width and being fed from the top portion, the slit nozzle further including an outlet from which the toner is applied to an application region of the imaging surface. The supply of liquid toner preferably includes a supply of pressurized liquid toner. Preferably, the imaging device further includes a developer surface situated proximate to the imaging surface downstream of said application region.

34 Claims, 5 Drawing Sheets

IMAGING DEVICE HAVING LIQUID TONER APPLICATOR USING A NOZZLE

The present invention relates generally to imaging apparatus using liquid toner and, more particularly, to devices and methods for applying liquid toner.

BACKGROUND OF THE INVENTION

Imaging apparatus using liquid toner development systems are well known in the art. A typical liquid toner development system includes a developer surface which engages a selectively discharged photoreceptor surface at a development region. The liquid toner is applied to either the developer surface or the photoreceptor surface, ahead of the development region, or directly to the development region. Thus, subsequent engagement between the developer surface and the photoreceptor surface results in development of a layer of liquid toner on at least a portion of the photoreceptor surface.

There are various devices known in the art for supplying liquid toner in the development systems described above. According to one known method, the liquid toner is applied to the developer surface by a sponge which collects the toner from a toner reservoir. According to another known method, the toner is pumped from the reservoir and sprayed by a set of sprayers which are juxtaposed with the developer or photoreceptor surface along the width thereof. For color development, a plurality of sets of sprayers may be used, one for each color toner, or the different color toners may be sequentially pumped to the same set of sprayers.

Although the sprayer method is preferred because it allows a higher imaging speed, this method still has drawbacks. Since a number of sprayers are used to cover the entire width of the photoreceptor surface, the resultant toner layer is not completely homogeneous because regions of the photoreceptor directly across from the sprayers are generally supplied with more toner than other regions of the photoreceptor. This may result in the appearance of streaks, on the final image, which are particularly noticeable in high resolution printing. The apparentness of such streaks may be reduced by using a higher density of sprayers, for example using a staggered arrangement of sprayers, or by distributing the liquid toner relatively evenly on the developer roller before contact with the photoreceptor surface. However, such methods are not always completely effective.

Japanese Patent Application 5-46029 describes a development system for electrostatic imaging apparatus which uses a toner applicator having an elongated, slit-shaped, nozzle, juxtaposed with the development region between the photoreceptor and developer surfaces. The slit applicator provides a generally continuous body of toner to the development region. The specified width of the slit is between 10–3000 $\mu$m. For development of color images, a plurality of such slit applicators, each applicator being supplied with a different color toner, are sequentially brought into juxtaposition with the photoreceptor surface. To avoid dripping of toner from the applicator, Patent Application 5-46029 suggests using an outlet control valve, at the slit outlet of each applicator, to bar the outlet of toner between imaging cycles.

It is believed that use of existing slit applicators, such as these suggested in Patent 5-46029, is not practical due to a number of problems. For example, the use of exit valves for controlling the flow of toner through the slit applicators, to avoid dripping from the applicators, is difficult to implement. Additionally, in color imaging systems, the need to physically switch between the different color applicators may consume considerable space and time and may be complicated to implement.

SUMMARY OF THE INVENTION

The present invention seeks to provide an improved electrostatic imaging device including a toner applicator which provides a continuous body of liquid toner, hereinafter referred to as a toner curtain, to a development arrangement of the imaging device. In a preferred embodiment of the invention, the development arrangement includes an imaging surface bearing a latent image and a developer surface which engages the latent image bearing surface at a development region.

According to one aspect of the present invention, the toner applicator includes a slit-nozzle which is positioned juxtaposed with the imaging surface, at an application region upstream of the development region. The liquid toner is preferably supplied to the slit-nozzle via an applicator chamber which has a relatively narrow top portion from which the slit nozzle is fed. Thus, air bubbles which may form in the applicator chamber are forced to exit the slit nozzle at the beginning of each imaging cycle, preventing formation of random air gaps in the resultant toner curtain.

According to another aspect of the present invention, the slit-nozzle has a shape which provides a substantially spatially uniform toner curtain having a predetermined velocity and orientation with respect to the imaging surface. In a preferred embodiment of the invention, the slit nozzle has first and second inner slit walls, the first slit wall extending slightly beyond the second slit wall and the second slit wall being downstream of the first slit wall in respect to the direction of motion of the imaging surface. The edges of the first and second slit walls are preferably chamfered to allow a smooth exit of the liquid toner curtain from the slit nozzle. The chamfer angle of the first slit wall is preferably smaller than that of the second slit wall.

This structure provides a stable toner curtain having a substantially constant orientation with respect to the imaging surface. The exiting toner curtain is preferably slightly inclined in the direction of the first slit surface. i.e. toward upstream on the imaging surface. The toner pressure supplied to the applicator chamber and the width and depth of the slit nozzle are preferably designed to provide the desired uniformity and velocity of the toner curtain, while preventing undesired effects such as dripping of toner and creation of air-gaps in the toner curtain.

According to yet another aspect of the present invention, adapted for color imaging systems, the toner applicator includes a plurality of integrally formed, adjacent, applicator chambers as described above. In a preferred embodiment of this aspect of the invention, each applicator chamber of the multi-color applicator supplies a different color toner through its slit nozzle. The different color nozzles are preferably arranged close together and at substantially equal distances from the imaging surface. However, adjacent color nozzles are preferably sufficiently separated from each other to avoid contamination therebetween due to "wind" from the fast-moving imaging surface.

In a preferred embodiment of the present invention, the imaging surface includes an organic or inorganic photoreceptor. However, in other, alternative, preferred embodiments of the invention, non-electrophotographic methods may be used for generating the electrostatic latent image. For example, the latent image may be a changeable or a permanent latent image generated by ionographic or other electrostatic image forming means.

In accordance with a preferred embodiment of the present invention there is thus provided an imaging device including a selectively charged imaging surface, having a width and moving in a direction perpendicular to the width and a toner applicator, the applicator including:

an applicator chamber having a top portion and containing a supply of liquid toner; and a slit nozzle having a long dimension comparable to the imaging surface width and being fed from the top portion, the slit nozzle further including an outlet from which the liquid toner is applied to an application region of the imaging surface.

In a preferred embodiment of the present invention, the device further includes a developer surface situated proximate to the imaging surface downstream of the application region. Preferably, the supply of liquid toner includes a supply of pressurized liquid toner.

Further, in accordance with a preferred embodiment of the invention, there is provided an imaging device including:

a selectively charged imaging surface having a development region and a toner applicator, the applicator including:

an applicator chamber which is selectively supplied with pressurized liquid toner; and a slit nozzle, fed from the applicator chamber, which applies a substantially continuous body of the liquid toner to an application region on the photoreceptor surface upstream of the development region.

In a preferred embodiment of the invention, the device further includes a valve which is selectively activated to interrupt the supply of pressurized liquid toner to the applicator chamber, wherein the application of the body of liquid toner from the slit is interrupted in accordance with the activation of the valve.

For example, an inlet valve can be provided, which when activated supplies pressurized liquid toner to the applicator chamber such that the toner is supplied to the application region as a direct result of the supply of pressurized liquid toner to the applicator chamber wherein, when the inlet valve is closed and inflow of pressurized liquid toner to the applicator chamber ceases, the slit nozzle remains substantially filled with liquid toner.

Additionally, in a preferred embodiment of the invention, the applicator chamber includes a top portion and the slit nozzle is fed from the top portion. Preferably, the top portion includes a relatively narrow extension of the application chamber.

In a preferred embodiment of the invention, the slit nozzle is generally vertical. Preferably, the slit nozzle has a depth of between 10 and 50 millimeters, desirably between 20 and 30 millimeters. Additionally or alternatively in a preferred embodiment, the slit nozzle has a width of between 10 and 3000 micrometers, desirably between 300 and 400 micrometers.

In a preferred embodiment of the invention, the slit nozzle includes first and second slit walls, the second slit wall being downstream of the first slit wall along the direction of motion of the imaging surface. The first slit wall preferably extends slightly beyond the second slit wall. Additionally or alternatively, in a preferred embodiment, the first and second slit walls have chamfered edges. Preferably, in this embodiment of the invention, the chamfer angle at the edge of the first slit wall is shallower than the chamfer angle at the edge of the second slit wall.

In accordance with a preferred embodiment of the invention, there is further provided an imaging device including a selectively charged imaging surface having a development region and a toner applicator, the applicator including:

a plurality of stationary applicator chambers, each containing a supply of liquid toner having a predetermined, respective, color; and a plurality of generally vertical slit nozzles, each slit nozzle being fed from a respective one of the stationary applicator chambers, each the slit nozzles having an outlet proximate to an application region of the imaging surface.

In a preferred embodiment of the invention, the supply of liquid toner of each application chamber includes a supply of pressurized liquid toner. Additionally, in a preferred embodiment, each of the slit nozzles is fed from a top portion of the respective application chamber. Preferably, the top portion includes a relatively narrow extension of the respective application chamber.

In a preferred embodiment of the invention, the device further includes a plurality of valves, each of which is selectively activated to interrupt the supply of pressurized liquid toner to a respective one of the plurality of applicator chambers, thereby interrupting the flow of toner from the slit nozzle.

In a preferred embodiment of the invention, each of the slit nozzles has a depth of between 10 and 50 millimeters, desirably between 20 and 30 millimeters. Additionally or alternatively in a preferred embodiment, each slit nozzle has a width of between 10 and 3000 micrometers, desirably between 300 and 400 micrometers.

In a preferred embodiment of the invention, each of the slit nozzles includes first and second slit walls, the second slit wall being downstream of the first slit wall along the direction of motion of the imaging surface. The first slit wall preferably extends slightly beyond the second slit wall. Additionally or alternatively, in a preferred embodiment, the first and second slit walls have chamfered edges. Preferably, in this embodiment of the invention, the chamfer angle at the edge of the first slit wall is shallower than the chamfer angle at the edge of the second slit wall.

In a preferred embodiment of the present invention, the selectively charged imaging surface includes a photoreceptor surface.

BRIEF DESCRIPTION OF THE DRAWINGS

The present invention will be understood and appreciated more fully from the following detailed description, taken in conjunction with the drawings in which.

DETAILED DESCRIPTION OF THE PREFERRED EMBODIMENT

Figure 1:
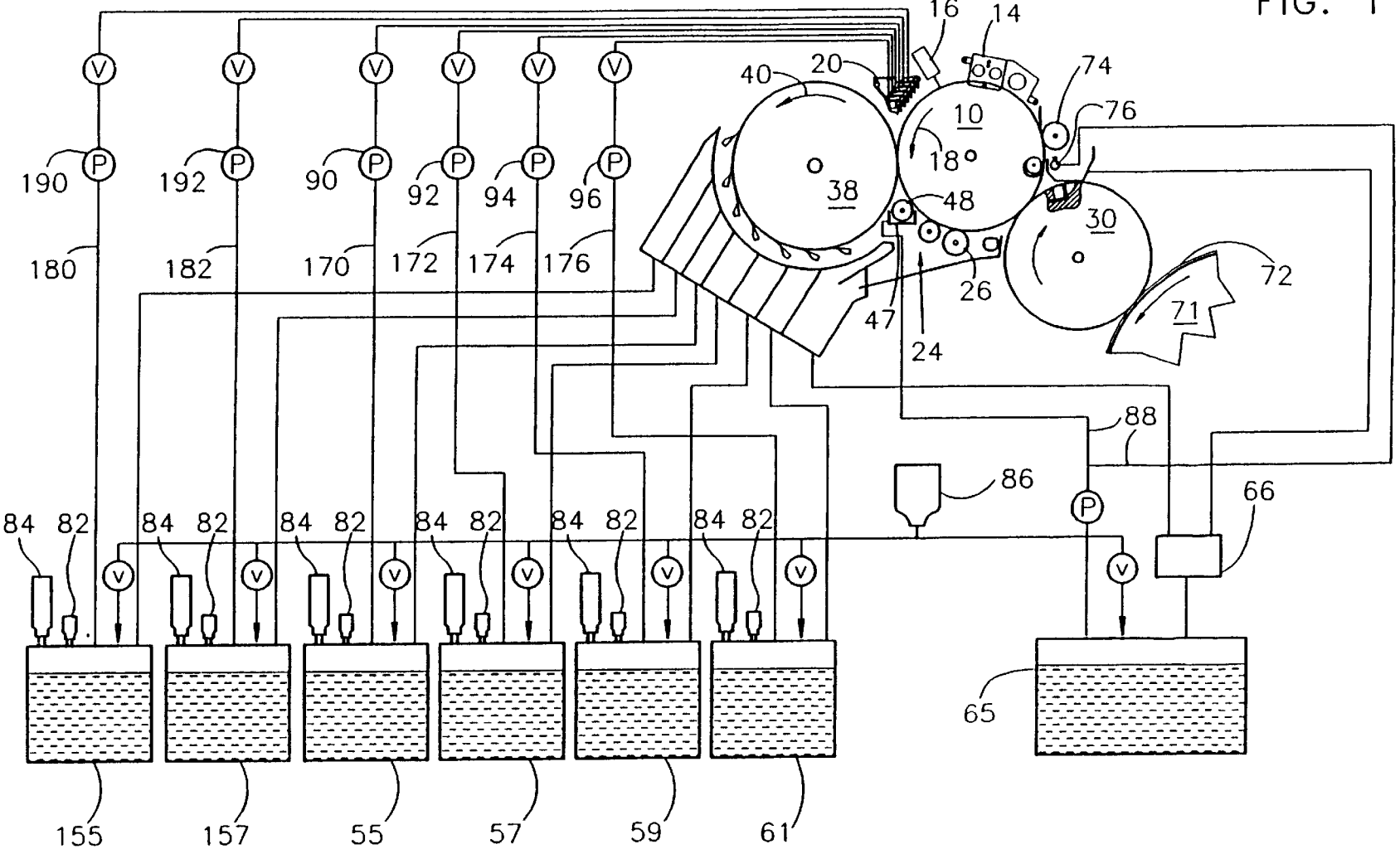
FIG. 1 is a simplified sectional illustration of electrostatic imaging apparatus constructed and operative in accordance with a preferred embodiment of the present invention.
Figure 2:
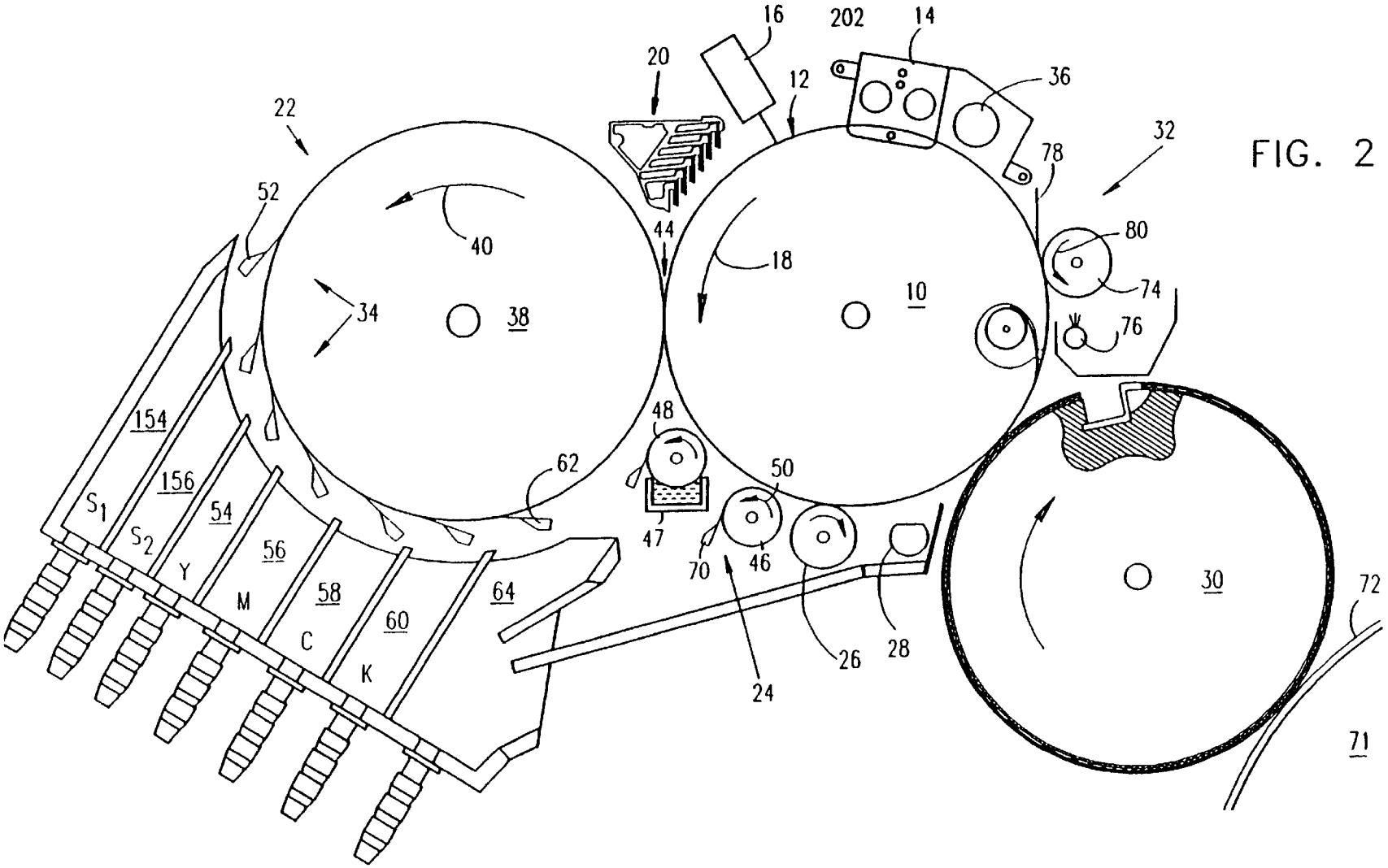
FIG. 2 is a simplified enlarged sectional illustration of the imaging apparatus of FIG. 1.

Reference is now made to FIGS. 1 and 2 which illustrate a multicolor electrostatic imaging system constructed and operative in accordance with a preferred embodiment of the present invention. As seen in FIGS. 1 and 2 there is provided an imaging sheet, preferably an organic photoreceptor 12, typically mounted on a rotating drum 10. Drum 10 is rotated about its axis by a motor or the like (not shown), in the direction of arrow 18, past charging apparatus 14, preferably a corotron, scorotron or roller charger or other suitable charging apparatus as are known in the art and which is adapted to charge the surface of sheet photoreceptor 12. The image to be reproduced is focused by an imager 16 upon the charged surface 12 at least partially discharging the photoconductor in the areas struck by light, thereby forming the electrostatic latent image. Thus, the latent image normally includes image areas at a first electrical potential and background areas at another electrical potential.

Photoreceptor sheet 12 may use any suitable arrangement of layers of materials as is known in the art, however, in the preferred embodiment of the photoreceptor sheet, certain of the layers are removed from the ends of the sheet to facilitate its mounting on drum 10.

This preferred photoreceptor sheet and preferred methods of mounting it on drum 10 are described in a co-pending application of Belinkov et al., IMAGING APPARATUS AND PHOTORECEPTOR THEREFOR, filed Sep. 7, 1994, assigned Ser. No. 08/301,775 now U.S. Pat. No. 5,508,790 and in coresponding applications filed in other countries, the disclosure of which are incorporated herein by reference. Alternatively, photoreceptor 12 may be deposited on the drum 10 and may form a continuous surface. Furthermore, photoreceptor 12 may be a non-organic type photoconductor based, for example, on a compound of Selenium.

It should be noted that in other, alternative, preferred embodiments of the invention, non-electrophotographic methods may be used for generating the electrostatic latent image. For example, the latent image may be a changeable or a permanent latent image generated by ionographic or other electrostatic image forming means.

In a preferred embodiment of the present invention, imaging apparatus 16 is a modulated laser beam scanning apparatus, or other laser imaging apparatus such as is known in the art.

Also associated with drum 10 and photoreceptor sheet 12, in the preferred embodiment of the invention, are a multicolor toner curtain applicator 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36.

Developing assembly 22 preferably includes a development roller 38. Development roller 38 is preferably spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

Multicolor toner curtain applicator 20, whose operation and structure is described in detail below, is preferably fixedly mounted juxtaposed with a portion of the surface of photoreceptor 12, hereinafter referred to as application region 21, upstream of a development region 44 between photoreceptor 12 and development roller 38. In accordance with the present invention, as described below, applicator 20 produces a continuous body of liquid toner, hereinafter referred to as a toner curtain, which propagates in the direction of application region 21. For color imaging, a plurality of different color toner curtains are sequentially applied to region 21 by toner applicator 20.

Color specific cleaning blade assemblies 34 are operatively associated with developer roller 38 for separate removal of residual amounts of each colored toner remaining thereon after development. Each of blade assemblies 34 is selectably brought into operative association with developer roller 38 only when toner of a color corresponding thereto is supplied to application region 21 by toner curtain applicator 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 which serves to direct the toner removed by the cleaning blade assemblies 34 from the developer roller 38 to separate collection containers 54, 56, 58, 60, 154 and 156, one for each color toner, to prevent contamination of the various color toners by mixing therebetween. The different color toners collected by collection containers 54, 56, 58, 60, 154 and 156 are recycled to corresponding toner reservoirs 55, 57, 59, 61, 155 and 157. A final toner directing member 62 always engages the developer roller 38 and the toner collected thereat is supplied into collection container 64 and thereafter to a carrier-liquid reservoir 65 via a separator 66 which is operative to separate relatively clean carrier liquid from the various colored toner particles. The separator 66 may be typically of the type described in U.S. Pat. No. 4,985,732, the disclosure of which is incorporated herein by reference.

In a preferred embodiment of the invention, as described in PCT Publication WO 92/13297, the disclosure of which is incorporated herein by reference, where the imaging speed is very high, a background cleaning station 24 typically including a reverse roller 46 and a wetting roller 48 is provided. Reverse roller 46 which rotates in a direction indicated by arrow 50 is preferably electrically biased to a potential intermediate that of the image and background areas of photoconductive drum 10, but different from that of the development roller. Reverse roller 46 is preferably spaced apart from photoreceptor sheet 12 thereby forming a gap therebetween which is typically 40 to 150 micrometers.

Wetting roller 48 is preferably partly immersed in a fluid bath 47, which preferably contains carrier liquid received from carrier liquid reservoir 65 via conduit 88. Wetting roller 48, which preferably rotates in the same sense as that of drum 10 and reverse roller 46, operates to wet photoreceptor sheet 12 with non-pigmented carrier liquid upstream of reverse roller 46. The liquid supplied by wetting roller 48 replaces the liquid removed from drum 10 by development assembly 22, thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via collection container 64 and separator 66.

Wetting roller 48 is preferably electrically biased to a potential intermediate that of the image and background areas of photoconductive drum 10, but different from that of the development roller. This biasing of wetting roller 48 assists in removing toner particles from the background areas of photoreceptor sheet 12. Wetting roller 48 is preferably spaced apart from photoreceptor sheet 12 thereby forming a gap therebetween which is typically 40 to 200 micrometers.

The apparatus embodied in reference numerals 46, 47, 48 and 70 is generally not required for low speed systems, but is preferably included in high speed systems.

Preferably, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles.

Discharge device 28 is operative to flood sheet 12 with light which discharges the voltage remaining on sheet 12, mainly to reduce electrical breakdown and improve transfer of the image to intermediate transfer member 30. Operation of such a device in a write black system is described in U.S. Pat. No. 5,280,326, the disclosure of which is incorporated herein by reference.

FIGS. 1 and 2 further show that multicolor toner curtain applicator 20 receives separate supplies of colored toner typically from-the six different reservoirs 55, 57, 59, 61, 155 and 157. FIG. 1 shows the six different colored toner reservoirs 55, 57, 59, 61, 155 and 157, one of which typically contains a black toner, denoted K. The other reservoirs may contain any suitable standard or custom-selected colors, for example Yellow, Magenta and Cyan denoted Y, M and C, respectively, and other, special, colors denoted $S_1$ and $S_2$, respectively. Pumps 90, 92, 94, 96, 190 and 192 may be provided along respective supply conduits 170, 172, 174, 176, 178, 180 and 182 for providing a desired amount of pressure to feed the colored toner to multicolor toner applicator 20. The use of six different reservoirs allows for custom colored tones in addition to the standard process colors. Alternatively, for standard 4-color imaging, toner applicator 20 is associated with only four different color toner reservoirs, typically containing the colors Yellow, Magenta, Cyan and Black.

A preferred type of toner for use with the present invention is that described in Example 1 of U.S. Pat. No. 4,794,651, the disclosure of which is incorporated herein by reference or variants thereof as are well known in the art. For colored liquid developers, carbon black is replaced by color pigments as is well known in the art. Other toners may alternatively be employed, including liquid toners and, as indicated above. Preferred liquid toners are also described in the various patents and patent applications referred to herein and/or incorporated herein by reference.

Intermediate transfer member (ITM) 30 may be any suitable intermediate transfer member, for example, as described in U.S. Pat. Nos. 4,684,238 and 4,974,027 or in PCT Publication WO 90/04216, the disclosures of which are incorporated herein by reference. Alternatively, in a preferred embodiment of the invention, ITM 30 has a multi-layered transfer portion such as those described below or in U.S. Pat. Nos. 5,089,856 and 5,047,808, or in U.S. patent application Ser. No. 08/371,117 now U.S. Pat. No. 5,745,829, filed Jan. 11, 1995 and entitled IMAGING APPARATUS AND INTERMEDIATE TRANSFER BLANKET THEREFOR and coresponding patent applications filed in other countries, the disclosures of all of which are incorporated herein by reference. Member 30 is maintained at a suitable voltage and temperature for electrostatic transfer of the image thereto from the image bearing surface of photoreceptor 12. Intermediate transfer member 30 is preferably associated with a pressure roller 71 for transfer of the image onto a final substrate 72, such as paper, preferably by heat and pressure.

Cleaning apparatus 32 is operative to scrub clean the surface of photoreceptor 12 and preferably includes a cleaning roller 74, a sprayer 76 for spraying a non polar cleaning liquid, preferably chilled carrier liquid from reservoir 65, and a wiper blade 78 to complete the cleaning of the photoconductive surface. The sprayed carrier liquid assists in the scrubbing process and cools the photoreceptor surface. Cleaning roller 74 which may be formed of any synthetic resin known in the art for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with a preferred embodiment of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place. Alternatively, each single color image is separately transferred to the substrate via the intermediate transfer member. In this case, the substrate is fed through the machine once for each color or is held on a platen and contacted with intermediate transfer member 30 during image transfer. Alternatively, the intermediate transfer member is omitted and the developed single color images are transferred sequentially directly from drum 10 to substrate 72.

It should be understood that the invention is not limited to the specific type of image forming system used and the present invention is also useful with any suitable imaging system. The specific details given above for the image forming system are included as part of a best mode of carrying out the invention, however, many aspects of the invention are applicable to a wide range of systems as known in the art for electrostatic and offset ink printing and copying. Furthermore, other specific details of the present image forming system, some of which may be part of the best mode of carrying out the invention, are included in the publications incorporated herein by reference.

Figure 3:
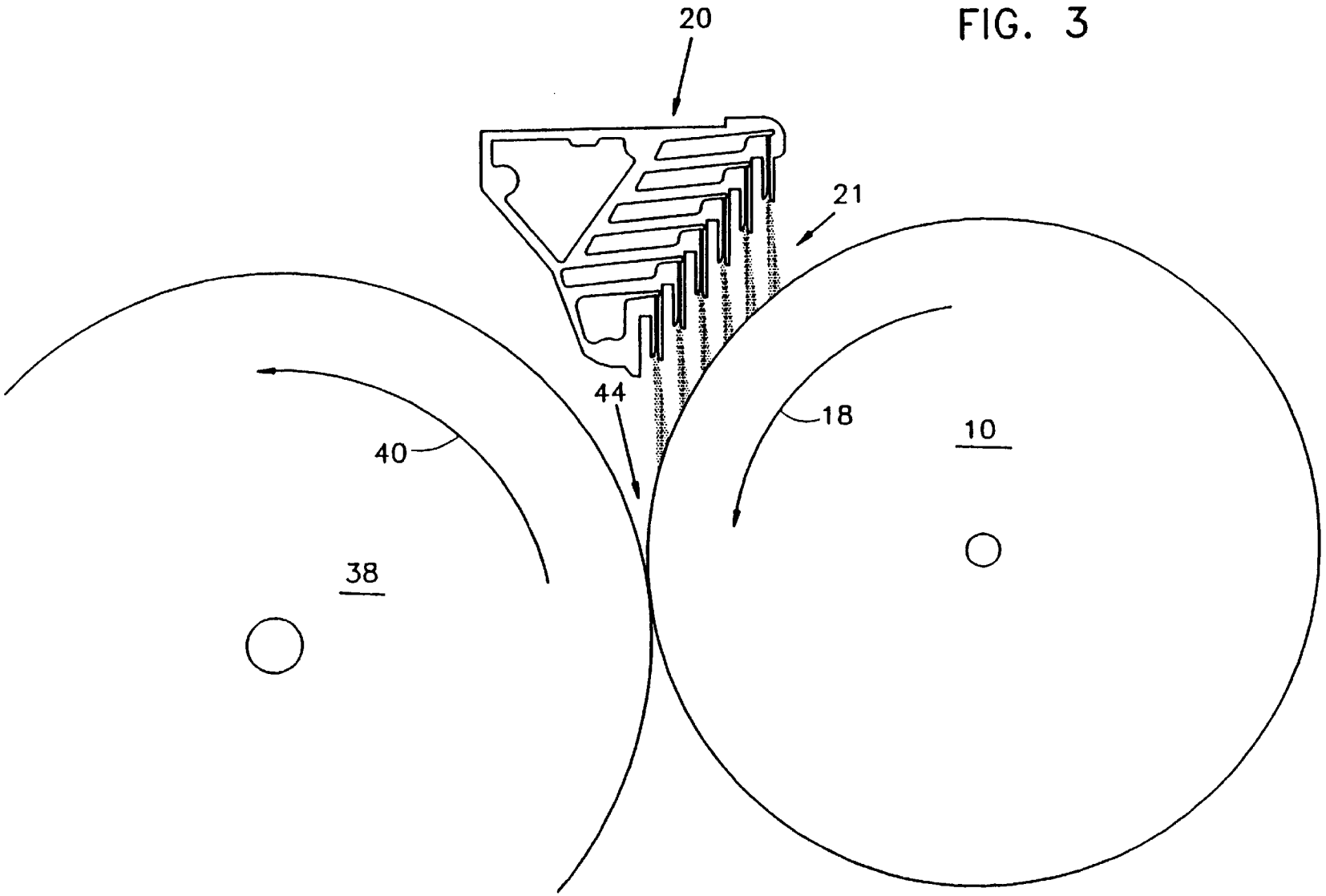
FIG. 3 is a simplified, further enlarged, sectional illustration of the imaging apparatus of FIG. 1, showing elements of a development system in accordance with a preferred embodiment of the present invention.
Figure 4:
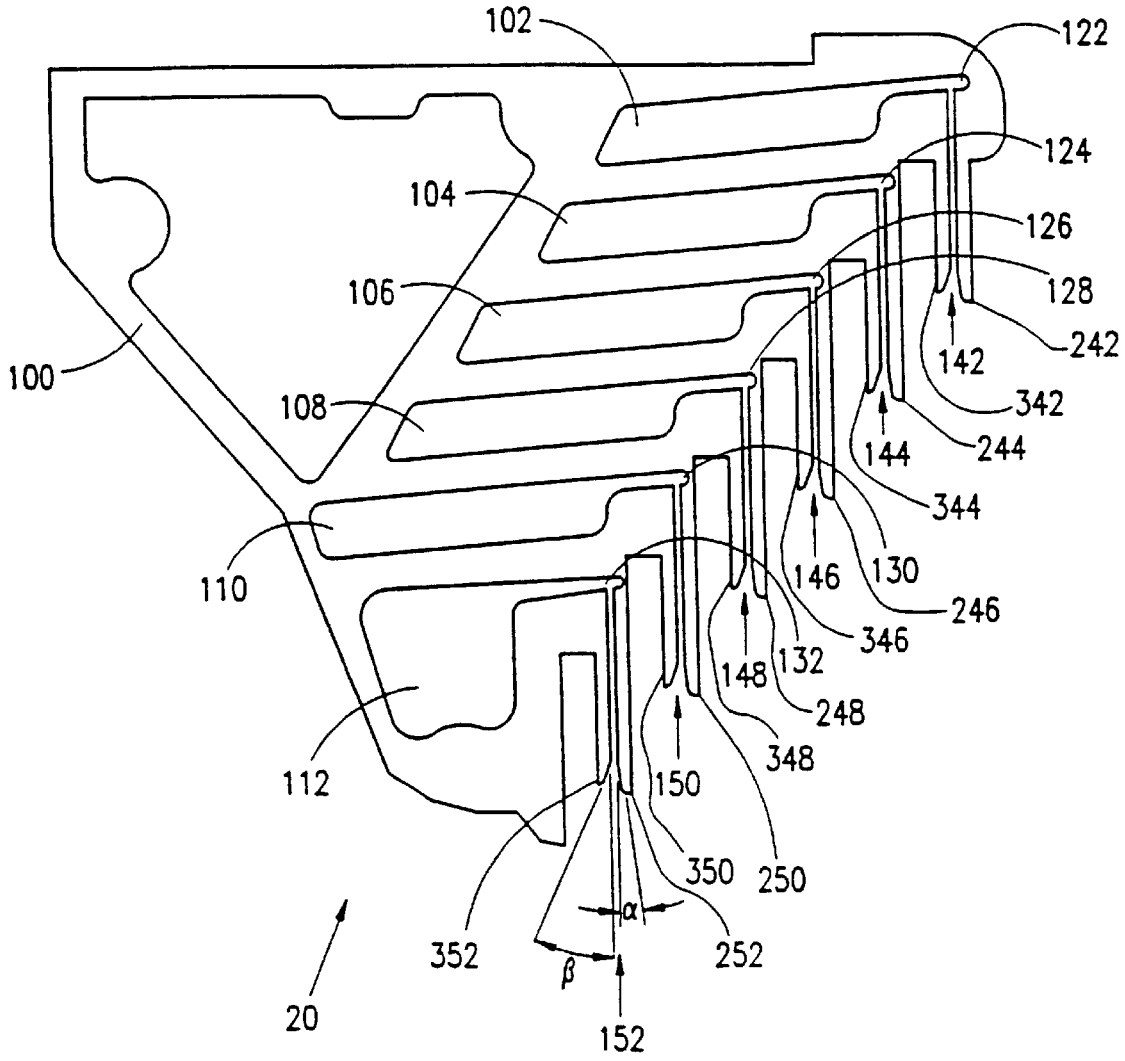
FIG. 4 is a detailed, schematic, sectional illustration of a multi-color toner curtain applicator constructed in accordance with a preferred embodiment of the present invention.
Figure 5:
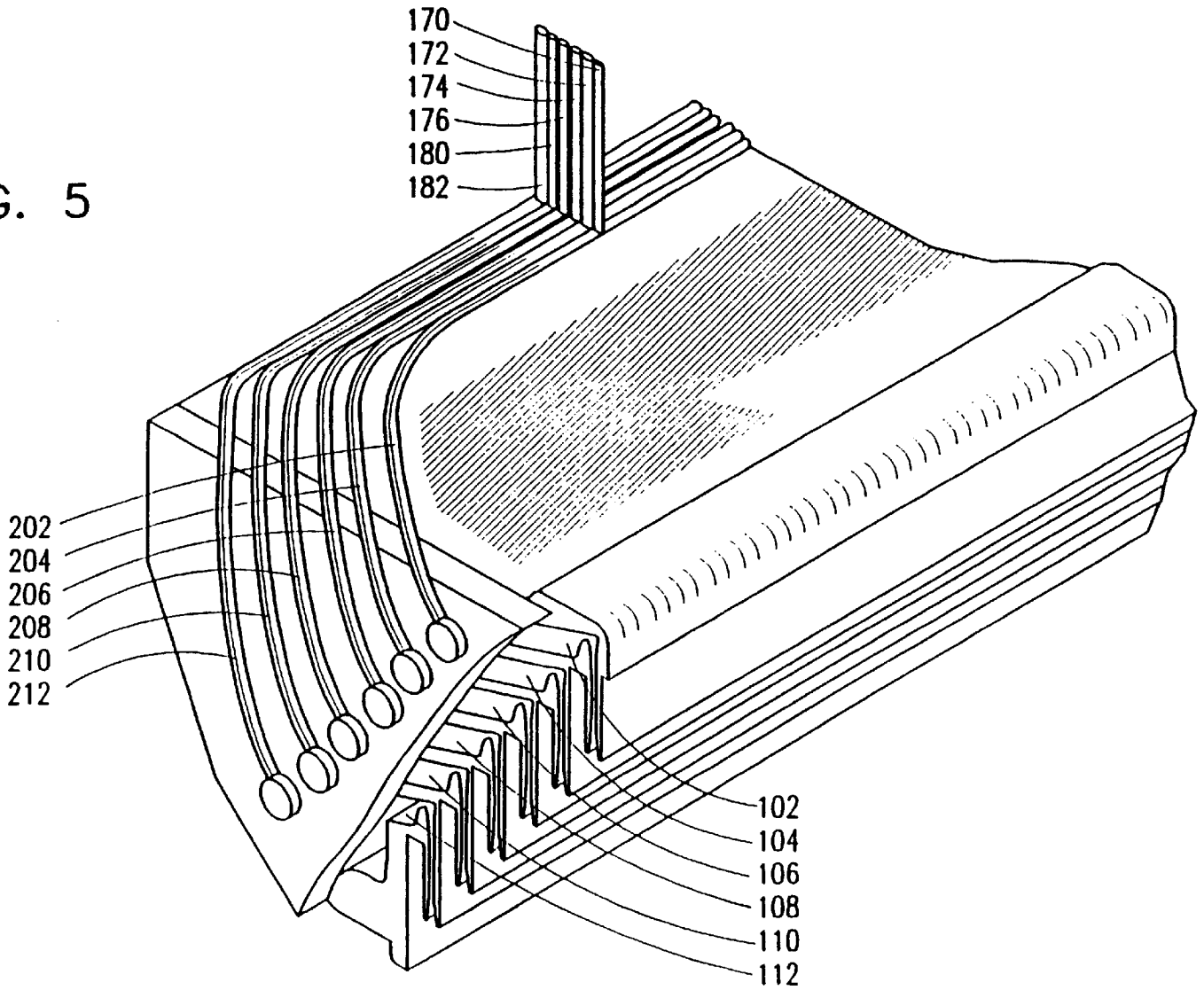
FIG. 5 is a perspective, schematic, partly cut-away, illustration of the multi color toner curtain applicator of FIG. 4.

Reference is now made also to FIGS. 3–5. FIG. 3 schematically illustrates multicolor toner curtain applicator 20 juxtaposed with application region 21 of photoreceptor 12. FIG. 4 is a more detailed, sectional, illustration of multicolor applicator 20. FIG. 5 is a perspective illustration of part of applicator 2 connected to toner supply conduits 170, 172, 174, 176, 180 and 182.

As shown in FIG. 4, applicator 20 includes toner applicator chambers 102, 104, 106, 106, 110 and 112 having respective top portions 122, 124, 126, 128, 130 and 132, which are preferably formed as relatively narrow extensions of the respective applicator chambers. Applicator 20 further includes a plurality of slit nozzles 142, 144, 146, 148, 150 and 152 which are preferably connected to top portions 122, 124, 126, 128, 130 and 132, respectively. Chambers 102, 104, 106, 108, 110 and 112 and slit nozzles 142, 144, 146, 148, 150 and 152 are preferably all formed in a single, preferably aluminum, applicator block 100. Slit nozzles 142, 144, 146, 148, 150 and 152 have respective first walls 242, 244, 246, 248, 250 and 252 and respective second walls 342, 344, 346, 348, 350 and 352. First walls 242, 244, 246, 248, 250 and 252 are preferably extend slightly beyond respective second walls 342, 344, 346, 348, 350 and 352 for reasons described below. As shown in FIG. 4, first walls 242, 244, 246, 248, 250 and 252 and second walls 342, 344, 346, 348, 350 and 352 all have chamfered edges, however, the chamfer angle, $\alpha$, at the edges of the first walls is preferably smaller than the chamfer angle, $\beta$, at the edges of the second walls for reasons described below.

As shown in FIG. 5, chambers 102, 104, 106, 108, 110 and 112 are preferably connected to toner supply conduits 170, 172, 174, 176, 180 and 182 via respective split conduits 202, 204, 206, 208, 210 and 212. FIG. 5 shows one end of each of split conduits 202, 204, 206, 208, 210 and 212 connected to a respective end of each of chambers 102, 104, 106, 108, 110 and 112, respectively. It should be appreciated that the other ends of conduits 202, 204, 206, 208, 210 and 212 are similarly connected to the other ends of chambers 102, 104, 106, 108, 110 and 112, respectively.

During operation of the imaging apparatus, the different color toners which are sequentially pumped into applicator chambers 102, 104, 106, 108, 110 and 112, via conduits 202, 204, 206, 208, 210 and 212, respectively, are forced to exit slit nozzles 142, 144, 146, 148, 150 and 152 at a high velocity, preferably on the order of 300 millimeters per second. As shown in FIG. 3, the toner curtains which exit nozzles 142, 144, 146, 148, 150 and 152 are sequentially received by the surface of photoreceptor 12 at adjacent locations of application region 21.

Since the surface velocity of photoreceptor 12, typically on the order of 600 millimeters per second, is generally much higher than the velocity of the toner curtains supplied by applicator 20, the toner curtain should contact surface 12 before reaching development region 21. To counteract "wind" in the direction of arrow 18, resulting from the high surface velocity of photoreceptor 12, the toner curtains are preferably not generated vertically but, rather, they are generated slightly against the direction of arrow 18. This counter-drift orientation of the toner curtains is achieved by the slight differences in length between first walls 242, 244, 246, 248, 250 and 252 and second walls 342, 344, 346, 348, 350 and 352 and by the different chamfer angles, $\alpha$ and $\beta$, of the walls.

It is appreciated that when the supply of liquid toner to a given applicator chamber 102, 104, 106, 108, 110 or 112 is cut-off after each imaging cycle, air bubbles may enter the chamber and may remain caught therein until the next imaging cycle is activated. Air bubbles may also be occasionally introduced to chambers 102, 104, 106, 108, 110 or 112 from the respective toner reservoirs and toner conduits. In accordance with the preferred structure of the present invention, any such air bubbles caught in chambers 102, 104, 106, 108, 110 or 112 gravitate into top portions 122, 124, 126, 128, 130 and 132, respectively, which are highest regions in the chambers. Thus, when the pressured supply of liquid toner is resumed for the next imaging cycle, the air bubbles in top portions 122, 124, 126, 128, 130 and 132 are forced to exit through nozzles 142, 144, 146, 148, 150 and 152, respectively, at the outset of the respective imaging cycle and prior to actual imaging.

In a preferred embodiment of the invention, the depth of each of nozzles 142, 144, 146, 148, 150 and 152, i.e. the length of the first and second walls, is between 10 and 50 millimeters, preferably 20 to 30 millimeters. It has been found that shallower slits may cause spatial non-uniformity of the resultant toner curtains and that much deeper slits may impose a high resistance on the toner supply system. The average width of slits 142, 144, 146, 148, 150 and 152 of the applicator 20 described above is preferably between 300 or 400 micrometers, although other widths in the range of 10–3000 micrometers may also be suitable. This combination of parameters avoids backup of air into the chambers through the slit nozzles and/or dripping of the slit nozzles. In a preferred embodiment of the invention, the width, depth and shape of each of slits 142, 144, 146, 148, 150 and 152 is also a function of the viscosity and surface tension of the respective liquid toners supplied to chambers 102, 104, 106, 108, 110 and 112 and may be adjusted to provide dripless liquid toner delivery for the particular liquid toner employed.

It will be appreciated by persons skilled in the art that the present invention is not limited by the description and example provided hereinabove. Rather, the scope of this invention is defined only by the claims which follow:

We claim:

1. A toner applicator for applying a liquid toner to a selectively charged moving imaging surface, said moving imaging surface having a width and moving in a direction perpendicular to said width, the applicator comprising:

an applicator chamber containing a supply of liquid toner; and a slit nozzle, which is fed at an inlet thereof from an outlet of the application chamber proximate an uppermost portion of the applicator chamber, said slit nozzle further comprising a slit outlet, situated below said inlet, from which said liquid toner is applied to an application region of said imaging surface, said slit outlet having an elongate dimension which extends substantially along the entire width of the imaging surface, wherein the slit nozzle comprises first and second slit walls, the second slit wall being downstream of the first slit wall along the direction of motion of the imaging surface and wherein said slit nozzle has a width between said first and second walls of between 10 and 300 micrometers; and wherein said first slit wall extends slightly beyond the second slit wall.

2. A toner applicator according to claim 1 wherein said slit nozzle is generally vertical.

3. A toner applicator according to claim 1 and including an inlet valve, which when activated supplies pressurized liquid toner to the applicator chamber such that said toner is supplied to said application region as a direct result of the supply of pressurized liquid toner to the applicator chamber wherein, when said inlet valve is closed and inflow of pressurized liquid toner to the applicator chamber ceases, said slit nozzle remains at least partly filled with liquid toner.

4. A toner applicator according to claim 1 wherein the distance between the inlet and slit outlet of the slit nozzle is between 10 and 50 millimeters.

5. A toner applicator according to claim 4 wherein the distance is between 20 and 30 millimeters.

6. An imaging device comprising:

at least one toner applicator according to claim 1; and a selectively charged moving imaging surface to which said toner applicator applies liquid toner.

7. An imaging device according to claim 6 wherein said slit nozzle has a fixed spatial relationship to the imaging surface which relationship does not change as the color of the toner being applied changes.

8. An imaging device according to claim 7 wherein the at least one toner applicator comprises a plurality of toner applicators, each said applicator selectively applying a liquid toner of a different color to said imaging surface.

9. An imaging device according to claim 8 wherein said plurality of slit outlets are situated proximate to each other and to the imaging surface, the slit nozzles being displaced from each other in the direction of motion of the imaging surface.

10. An imaging device according to claim 6 wherein the at least one toner applicator comprises a plurality of toner applicators, each said applicator selectively applying a liquid toner of a different color to said imaging surface.

11. An imaging device according to claim 10 wherein said plurality of slit outlets are situated proximate to each other and to the imaging surface, the slit nozzles being displaced from each other in the direction of motion of the imaging surface.

12. A toner applicator according to claim 1 wherein said slit nozzle has a width of between 300 and 400 micrometers.

13. A toner applicator according to claim 1 wherein said first and second slit walls have chamfered edges at said slit outlet.

14. A toner applicator in accordance with claim 1 and including:

an inlet valve, which when activated supplies pressurized liquid toner to the applicator chamber such that said toner is supplied to said application region as a direct result of the supply of pressurized liquid tone chamber;

wherein, when said inlet valve is closed and inflow of pressurized liquid toner to the applicator chamber ceases, the slit nozzle remains at least partly filled with liquid toner.

15. A toner applicator for applying a liquid toner to a selectively charged imaging surface having a development region, said applicator comprising:

an applicator chamber which is selectively supplied with pressurized liquid toner;

a slit nozzle, fed, at an inlet thereto, from an outlet of the applicator chamber, which slit nozzle applies, from a slit outlet thereof, situated below the inlet, a substantially continuous body of liquid toner to an application region on the photoreceptor surface upstream of said development region; and an inlet valve, which when activated supplies pressurized liquid toner to the applicator chamber such that said toner is supplied to said application region as a direct result of the supply of pressurized liquid toner to the applicator chamber wherein, when said inlet valve is closed and inflow of pressurized liquid toner to the applicator chamber ceases, said slit nozzle remains substantially filled with liquid toner.

16. A toner applicator according to claim 15 wherein said outlet from the applicator chamber is situated proximate an uppermost portion of the applicator chamber.

17. A toner applicator according to claim 16 wherein said slit nozzle is generally vertical.

18. A toner applicator according to claim 15 wherein said slit nozzle is generally vertical.

19. A toner applicator according to claim 15 wherein said slit nozzle comprises first and second slit walls, the second slit wall being downstream of the first slit wall along the direction of motion of the imaging surface.

20. A toner applicator according to claim 19 wherein said slit nozzle has a width between said first and second walls of between 10 and 3000 micrometers.

21. A toner applicator according to claim 20 wherein said slit nozzle has a width of between 300 and 400 micrometers.

22. A toner applicator according to claim 19 wherein said first slit wall extends slightly beyond said second slit wall.

23. A toner applicator according to claim 22 wherein said first and second slit walls have chamfered edges at said slit outlet.

24. A toner applicator according to claim 19 wherein said first and second slit walls have chamfered edges at said slit outlet.

25. A toner applicator according to claim 24 wherein the chamfer angle at the edge of said first slit wall is shallower than the chamfer angle at the edge of the second slit wall.

26. An imaging device comprising:

at least one toner applicator according to claim 15; and a selectively charged moving imaging surface to which said toner applicator applies liquid toner.

27. An imaging device according to claim 26 wherein said slit nozzle has a fixed spatial relationship to the imaging surface which relationship does not change as the color of the toner being applied changes.

28. An imaging device according to claim 27 wherein the at least one toner applicator comprises a plurality of toner applicators, each said applicator selectively applying a liquid toner of a different color to said imaging surface.

29. An imaging device according to claim 28 wherein said plurality of slit outlets are situated proximate to each other and to the imaging surface, the slit nozzles being displaced from each other in the direction of motion of the imaging surface.

30. An imaging device according to claim 26 wherein the at least one toner applicator comprises a plurality of toner applicators, each said applicator selectively applying a liquid toner of a different color to said imaging surface.

31. An imaging device according to claim 30 wherein said plurality of slit outlets are situated proximate to each other and to the imaging surface, the slit nozzles being displaced from each other in the direction of motion of the imaging surface.

32. A toner applicator for applying a liquid toner to a selectively charged moving imaging surface, said moving imaging surface having a width and moving in a direction perpendicular to said width, the applicator comprising:

an applicator chamber containing a supply of liquid toner; and a slit nozzle, which is fed at an inlet thereof from an outlet of the application chamber proximate an uppermost portion of the applicator chamber, said slit nozzle further comprising a slit outlet, situated below said inlet, from which said liquid toner is applied to an application region of said imaging surface, said slit outlet having an elongate dimension which extends substantially along the entire width of the imaging surface, wherein the slit nozzle comprises first and second slit walls, the second slit wall being downstream for the first slit wall along the direction of motion of the imaging surface and wherein said slit nozzle has a width between said first and second walls of between 10 and 300 micrometers; and wherein the distance between the slit inlet and slit outlet is between 10 and 50 millimeters.

33. A toner applicator according to claim 32 wherein the distance is between 20 and 30 millimeters.

34. A toner applicator in accordance with claim 32 and including:

an inlet valve, which when activated supplies pressurized liquid toner to the applicator chamber such that said toner is supplied to said application region as a direct result of the supply of pressurized liquid toner chamber, wherein, when said inlet valve is closed and inflow of pressurized liquid toner to the applicator chamber ceases, the slit nozzle remains at least partly filled with liquid toner.

* * * * *

UNITED STATES PATENT AND TRADEMARK OFFICE

CERTIFICATE OF CORRECTION

PATENT NO. : 5,915,152

DATED : June 22, 1999

INVENTOR(S) : I. MEIRI et al.

It is certified that error appears in the above-identified patent and that said Letters Patent is hereby corrected as shown below:

At column 11, line 37 (claim 14, line 6) of the printed patent, "tone" should be —toner—.

At column 12, line 63 (claim 32, line 17) of the printed patent, "for" should be —of—.

Signed and Sealed this

Fifth Day of September, 2000

*Attest:*

Q. TODD DICKINSON

*Attesting Officer*

*Director of Patents and Trademarks*